US011680563B2

(12) United States Patent
Lee et al.

(10) Patent No.: US 11,680,563 B2
(45) Date of Patent: Jun. 20, 2023

(54) COMPRESSOR INCLUDING ROTOR FRAME

(71) Applicant: LG Electronics Inc., Seoul (KR)

(72) Inventors: Jongmok Lee, Seoul (KR); Kyeongho Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 497 days.

(21) Appl. No.: 16/578,021

(22) Filed: Sep. 20, 2019

(65) Prior Publication Data

US 2020/0095989 A1 Mar. 26, 2020

(30) Foreign Application Priority Data

Sep. 21, 2018 (KR) ..... 10-2018-0114077

(51) Int. Cl.
*F04B 53/00* (2006.01)
*F04B 35/04* (2006.01)

(52) U.S. Cl.
CPC ..... *F04B 53/006* (2013.01); *F04B 35/04* (2013.01); *F04C 2240/807* (2013.01)

(58) Field of Classification Search
CPC ..... F04C 15/0042; F04C 29/0057; F04C 29/0085; F04C 29/0021; F04C 29/06; F04C 23/008; F04C 28/22; F04C 2240/807; F04C 2230/605; H02K 7/04; H02K 1/28; H02K 1/2786; H02K 37/06; F04B 53/006; F04B 35/04; F04B 39/0027; F04B 39/0094
USPC ..... 418/151; 188/378
See application file for complete search history.

(56) References Cited

U.S. PATENT DOCUMENTS

2004/0042917 A1* 3/2004 Chang ..... F04C 23/008 417/410.5
2008/0267799 A1* 10/2008 Kim ..... F04B 35/045 417/423.1
2013/0062466 A1* 3/2013 Sweet ..... B60K 7/0007 244/103 R (Continued)

FOREIGN PATENT DOCUMENTS

JP 2004084653 3/2004
JP 2004301038 10/2004

(Continued)

OTHER PUBLICATIONS

Korean Notice of Allowance in Korean Application No. 10-2018-0114077, dated Jan. 17, 2020, 1 pages (with English translation).

*Primary Examiner* — Kenneth J Hansen
(74) *Attorney, Agent, or Firm* — Fish & Richardson P.C.

(57) ABSTRACT

A compressor includes a casing, a motor, a cylinder block including a cylinder, and a piston. The motor include a stator and a rotor located outside the stator, a rotary shaft coupled to the rotor, and a rotor frame that accommodates the rotor and the rotary shaft and that is configured to rotate together with the rotor and transmit rotational force of the rotor to the rotary shaft. The rotary shaft includes an eccentric part configured to rotate based on the rotational force of the rotor and located at a position offset from a rotational axis of the rotary shaft. The piston is coupled to the rotary shaft and configured to reciprocate in the cylinder based on rotation of the eccentric part. The rotor frame has a mass distribution configured to compensate an unbalance force generated by movement of at least one of the piston or the eccentric part.

20 Claims, 16 Drawing Sheets

(56) References Cited

U.S. PATENT DOCUMENTS

2013/0140938 A1* 6/2013 Kaiser ..... H02K 7/04
29/598

FOREIGN PATENT DOCUMENTS

| | | | |
|---|---|---|---|
| JP | 2013074726 | | 4/2013 |
| JP | 2016006303 | | 1/2016 |
| JP | 2016006303 | A * | 1/2016 |

* cited by examiner

COMPRESSOR INCLUDING ROTOR FRAME

CROSS-REFERENCE TO RELATED APPLICATIONS

This application claims the benefit of Korean Patent Application No. 10-2018-0114077, filed on Sep. 21, 2018, which is hereby incorporated by reference as if fully set forth herein.

TECHNICAL FIELD

The present disclosure relates to a compressor, and more particularly to a compressor including a motor having an outer rotor structure.

BACKGROUND

A reciprocating compressor may suction and compress fluid using a reciprocating motion of a piston located in a cylinder, and discharge the compressed fluid to an outside of the compressor.

The reciprocating compressor may include reciprocating elements (e.g., a piston, a connection rod, a crank pin, etc.) and elements for converting rotational force of a motor into a reciprocating motion of the piston.

In some cases, during driving of the compressor, unbalance force or unbalance moment may occur due to movement of the piston, the connecting rod, the crank pin, and the eccentric part. For example, the unbalance force and the unbalance moment may be centrifugal force and centrifugal moment, respectively.

In some examples, during driving of the compressor, unbalance force or unbalance moments may occur due to movement of the piston and the connection rod, eccentric movement and centrifugal force of the eccentric part of the rotary shaft, etc.

In some cases, such unbalance force may cause vibration and noise during driving of the compressor.

In some examples, the compressor may include at least one balance weight in order to offset such unbalance force.

For instance, the balance weight can be provided to at least one of an upper part and a lower part of a rotor of the motor or a crank shaft (i.e., rotary shaft).

With the balance weight, vibration produced by a compressor body may be minimized, and noise caused by the vibration can be reduced, which may help to avoid breakage or damage of the compressor affected by excessive vibration.

In some examples, where the compressor include a motor having an outer rotor structure, it may be difficult to mount the balance weight to both an upper part and a lower part of the rotor.

In some cases, it may be difficult to install the balance weight stably to the compressor, for example, because of restriction in an installation space.

In some situations, where the balance weight is not mounted to the compressor, vibration characteristics of the compressor body (e.g., vibration characteristics in a Z-axis direction indicating a direction perpendicular to a plane where the reciprocating motion occurs) may be greatly deteriorated.

SUMMARY

The present disclosure describes a compressor including a rotor frame.

One object of the present disclosure may be to provide a compressor including a motor having an outer rotor structure. The compressor may include a rotor frame capable of efficiently offsetting (centrifugal) unbalance force or unbalance moments.

Another object of the present disclosure may be to provide a compressor including a motor provided with an outer rotor structure. The compressor may include a rotor frame such that the compressor can offset (centrifugal) unbalance force or unbalance moments using the shape of the rotor frame.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as implemented and broadly described herein, a compressor includes a motor having an outer rotor structure. In some examples, the rotor frame may include an asymmetrical mass reduction (slimming) structure. In the motor having the outer rotor structure, the rotor frame may be configured to transmit rotational force of the motor to a rotary shaft.

For example, the rotary shaft of the motor is fixed to the rotor frame, so that the rotor frame can rotate with the motor. The rotor frame may have mass distribution for additionally offsetting unbalance force generated by movement of at least one of the piston and the eccentric part of the compressor.

According to one aspect of the subject matter described in this application, a compressor includes: a casing that defines a sealed inner space and a motor that is located in the sealed inner space of the casing and that includes: a stator and a rotor located outside the stator, a rotary shaft coupled to the rotor, and a rotor frame that accommodates the rotor and the rotary shaft and that is configured to rotate together with the rotor and transmit rotational force of the rotor to the rotary shaft. The compressor further includes a cylinder block that is located in the sealed inner space of the casing and that includes a cylinder. The rotary shaft includes an eccentric part that is coupled to the cylinder block, that is configured to rotate based on the rotational force of the rotor, and that is located at a position offset from a rotational axis of the rotary shaft. The compressor further includes a piston coupled to the rotary shaft and configured to reciprocate in the cylinder based on rotation of the eccentric part. The rotor frame has a mass distribution that is configured to compensate an unbalance force generated by movement of at least one of the piston or the eccentric part.

Implementations according to this aspect may include one or more of the following features. For example, the rotor frame may include: an edge part coupled to the rotor, a center part that is coupled to the rotary shaft and that defines a coupling hole configured to receive the rotary shaft, and a plate-shaped part connects the edge part to the center part.

In some implementations, the rotor frame may have: a first side portion located at a first side with respect to a reference plane that is parallel to the rotational axis of the rotary shaft, where the eccentric part may be located at a position corresponding to the first side portion of the rotor frame; and a second side portion located at a second side opposite to the first side with respect to the reference plane. A weight of the first side portion may be greater than a weight of the second side portion. In some examples, the plate-shaped part may define a plurality of holes that have different sizes from each other and that allow the rotor frame to have the mass distribution.

In some examples, the plurality of the holes may include: one or more first holes defined at the first side portion corresponding to the position of the eccentric part; and one or more second holes defined at the second side portion corresponding to a position opposite to the eccentric part, where a width of the one or more first holes is less than a width of the one or more second holes.

In some examples, the plurality of the holes may include: one or more first holes defined at the first side portion corresponding to the position of the eccentric part; and one or more second holes defined at the second side portion corresponding to a position opposite to the eccentric part, where a number of the one or more first holes is less than a number of the one or more second holes.

In some implementations, the plate-shaped part may define a plurality of holes including: one or more first holes defined at the first side portion corresponding to the position of the eccentric part; and one or more second holes defined at the second side portion corresponding to a position opposite to the eccentric part, where a number of the one or more first holes is different from a number of the one or more second holes.

In some implementations, the piston may be configured to move along a movement plane, where the mass distribution of the rotor frame may be configured to compensate a first unbalance force applied in a direction perpendicular to the movement plane of the piston.

In some implementations, the compressor may further include a balance weight configured to compensate the unbalance force generated by movement of the at least one of the piston and the eccentric part. In some examples, the rotor frame has: a first side portion located at a first side with respect to a reference plane that is parallel to the rotational axis of the rotary shaft; and a second side portion located at a second side opposite to the first side with respect to the reference plane. The balance weight may be located at a position corresponding to the second side portion of the rotor frame, and a weight of the first side portion may be greater than a weight of the second side portion.

In some implementations, mass distributed between the angle of 90° and the angle of 270° with respect to the direction of the eccentric part may be lighter than mass distributed in the remaining parts.

In some implementations, the center of gravity (C.G.) of the rotor frame may be positioned between the angle of 340° and the angle of 20° with respect to the rotation center (C) when viewed from the direction of the eccentric part.

According to another aspect, a compressor includes a casing that defines a sealed inner space and a motor located in the sealed inner space of the casing. The motor includes: a stator and a rotor located outside the stator, a rotary shaft coupled to the rotor, and a rotor frame that accommodates the rotor and rotary shaft and that is configured to rotate together with the rotor and transmit rotational force of the rotor to the rotary shaft. The compressor further includes a cylinder block that is located in the sealed inner space of the casing and that includes a cylinder, where the rotary shaft includes an eccentric part that is coupled to the cylinder block, that is configured to rotate based on the rotational force of the rotor, and that is located at a position offset from a rotational axis of the rotary shaft. The compressor further includes a piston coupled to the rotary shaft and configured to reciprocate in the cylinder based on rotation of the eccentric part. The rotor frame has an unbalanced mass distribution along a circumferential direction about the rotational axis of the rotary shaft.

Implementations according to this aspect may include one or more of the following features. For example, the rotor frame may define a plurality of holes that are arranged along the circumferential direction and that cause the unbalanced mass distribution of the rotor frame, where the plurality of holes include: one or more first holes defined at a first circumferential portion of the rotor frame; and one or more second holes defined at a second circumferential portion of the rotor frame. A number of the one or more first holes is different from a number of the one or more second holes.

In some implementations, the rotor frame may include: an edge part coupled to the rotor; a center part that is coupled to the rotary shaft and that defines a coupling hole configured to receive the rotary shaft; and a plate-shaped part that connects the edge part to the center part. In some implementations, the compressor may further include a balance weight configured to compensate an unbalance force generated by movement of at least one of the piston and the eccentric part.

In some implementations, the rotor frame may have: a first side portion located at a first side with respect to a reference plane that is parallel to the rotational axis of the rotary shaft; and a second side portion located at a second side opposite to the first side with respect to the reference plane, where the balance weight is located at a position corresponding to the second side portion, and a weight of the first side portion is greater than a weight of the second side portion.

In some examples, the plate-shaped part may define a plurality of holes that have different sizes from each other and that cause the unbalanced mass distribution of the rotor frame. In some examples, the plurality of the holes may include: one or more first holes defined at the first side portion corresponding to a position opposite to the balance weight; and one or more second holes defined at the second side portion corresponding to the balance weight, where a width of the one or more first holes is less than a width of the one or more second holes. In some examples, each of the one or more first holes may be connected to one of the one or more second holes.

In some implementations, the plurality of holes may include: one or more first holes defined at the first side portion corresponding to a position opposite to the balance weight; and one or more second holes defined at the second side portion corresponding to the balance weight, where a number of the one or more first holes is less from a number of the one or more second holes. In some examples, each of the one or more first holes may be connected to one of the one or more second holes.

In some implementations, mass distributed between the angle of 90° and the angle of 270° with respect to the rotation center (C) may be lighter than mass distributed in the remaining parts.

In some implementations, the center of gravity (C.G.) of the rotor frame may be positioned between the angle of 340° and the angle of 20° with respect to the rotation center (C) when viewed from the direction of the eccentric part.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate implementation(s) of the disclosure and together with the description serve to explain the principle of the disclosure. In the drawings.

DETAILED DESCRIPTION

Figure 1:
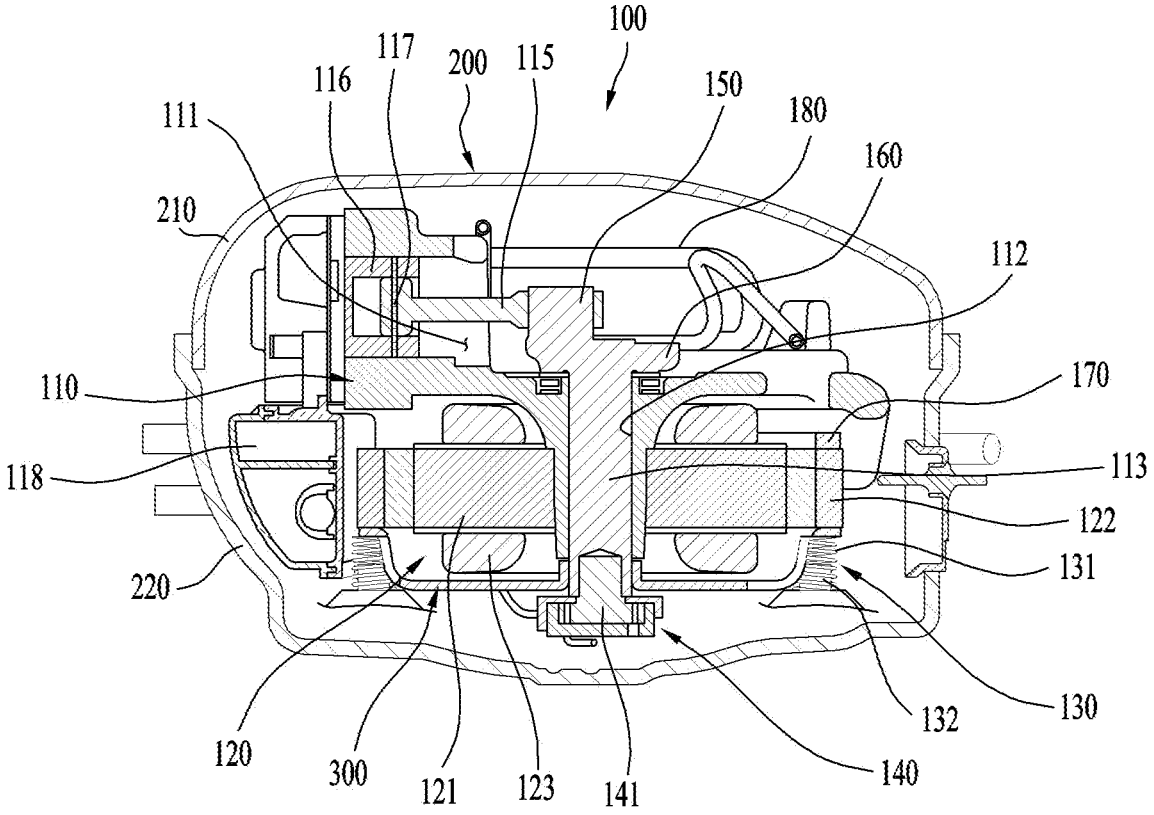
FIG. 1 is a cross-sectional view illustrating an example compressor including a rotor frame.

Reference will now be made in detail to the implementations of the present disclosure, examples of which are illustrated in the accompanying drawings, wherein like reference numerals refer to like elements throughout.

FIG. 1 is a cross-sectional view illustrating an example compressor including a rotor frame.

Referring to FIG. 1, the compressor 100 may include a casing 200 having a sealed inner space, and a cylinder block 110 installed in the inner space of the casing 200 and provided with a cylinder 111.

The casing 200 may be formed by a combination of an upper shell 210 and a lower shell 220. The upper shell 210 and the lower shell 220 may be coupled to be sealed to each other.

In the compressor 100, the casing 200 may form an outer wall structure that seals an inner space of the compressor 100 to form a refrigerant atmosphere and at the same time prevents refrigerant from being exposed to external air.

The cylinder block 110 may include a shaft support part 112 by which a rotary shaft (i.e., a crank shaft) 113 is supported.

The rotary shaft 113 may be rotatably installed in the shaft support part 112.

An eccentric part (i.e., a crank pin) 150 may be disposed over the rotary shaft 113, so that the eccentric part 150 can convert rotation movement into reciprocation movement. For example, the eccentric part 150 may be located at a position offset from a rotational axis of the rotary shaft.

In some examples, a piston 116 may be installed to the eccentric part 150 by a connection rod 115, such that the piston 116 may reciprocate in the cylinder 111. The piston 116 and the connection rod may be interconnected by a piston pin 117.

The motor 120 for transmitting rotational force to the rotary shaft 113 may be installed below a cylinder block 110.

The motor 120 may include a stator 121 installed in the vicinity of the shaft support part 112, and a rotor 122 configured to rotate outside the stator 121. That is, the motor 120 may construct an outer rotor structure.

A coil 123 may be wound on the stator 121 of the motor 120 so as to generate magnetic force. The rotor 122 may rotate by electromagnetic force generated by the stator 121 and the coil 123.

A rotor frame 300 for delivering rotational force of the motor 120 to the rotary shaft 113 may be installed below the motor 120.

A coupling hole 350 (see FIG. 2) coupled to the rotary shaft 113 may be formed at the center part of the rotor frame 300, and an edge part 330 (see FIG. 2) coupled to the rotor 122 of the motor 120 may be disposed outside the center part of the rotor frame 300. The coupling hole 350 may be connected to the edge part 330 by a panel-shaped plate part 340 having substantially uniform thickness.

In the case of using the motor 120 having the outer rotor structure, the rotor frame may be requisite for transmission of rotational force of the motor 120 to the rotary shaft 113.

The rotor frame 300 will hereinafter be described with reference to the attached drawings.

In some implementations, an oil supply part 140 for supplying oil to the cylinder 111 may be provided below the rotary shaft 113. The oil supply part 140 may include an oil pump 141.

The casing 200 may include a support part 130 configured to support a structure constructing the compressor 100. That is, the support part 130 may support the structure constructing the compressor 100 with respect to the casing 200.

In this case, the support part 130 may include a buffer member 131 such as a spring, and may further include a damper 132 to restrict vibration of the buffer member 131.

In some implementations, the rotor frame 300 may further include a pipe 180. The pipe 180 may be connected to the cylinder 111 such that compressed refrigerant can be discharged through the pipe 180.

In some implementations, the rotor frame 300 may include a suction muffler 118. The suction muffler 118 may be disposed in a flow passage through which low-pressure refrigerant is suctioned into the cylinder 111, and may be designed in consideration of sound transmission characteristics so as to reduce noise.

When the compressor 100 is driven, unbalance force (or unbalance moments) may occur due to reciprocation movement of the piston 116.

For example, unbalance force (or unbalance moments) may also occur by rotation of the eccentric part 150 connected to the rotary shaft 113.

In some examples, the unbalance force (or unbalance moments) may occur due to movement of at least one of the piston 116 and the eccentric part 150.

In some examples, the connection rod 115 may also be associated with movement of the piston 116.

When the compressor 100 is driven, unbalance force may cause vibration and noise caused by such vibration.

Therefore, the compressor 100 may include elements, each of which has a mass (or weight) to offset such unbalance force.

The elements for offsetting unbalance force may include a counter weight 160 formed not only at the end of the rotary shaft 113, but also at an opposite side of the eccentric part 150.

The elements for offsetting unbalance force may include a balance weight 170 installed at an upper side of the rotor 122.

In some examples, the elements for offsetting unbalance force may include the rotor frame 300 that has mass (weight)

distribution capable of offsetting unbalance force. For example, the rotor frame 300 may include a first side portion located at a first side with respect to a reference plane that is parallel to a rotational axis of the rotary shaft 113, where the eccentric part is located at a position corresponding to the first side portion of the rotor frame 300. The rotational axis of the rotary shaft 113 extends in a vertical direction of the compressor 100 illustrated in FIG. 1. The rotor frame 300 may further include a second side portion located at a second side opposite to the first side with respect to the reference plane. A weight of the first side portion may be greater than a weight of the second side portion to compensate unbalance force generated by movement of at least one of the piston or the eccentric part.

Figure 2:
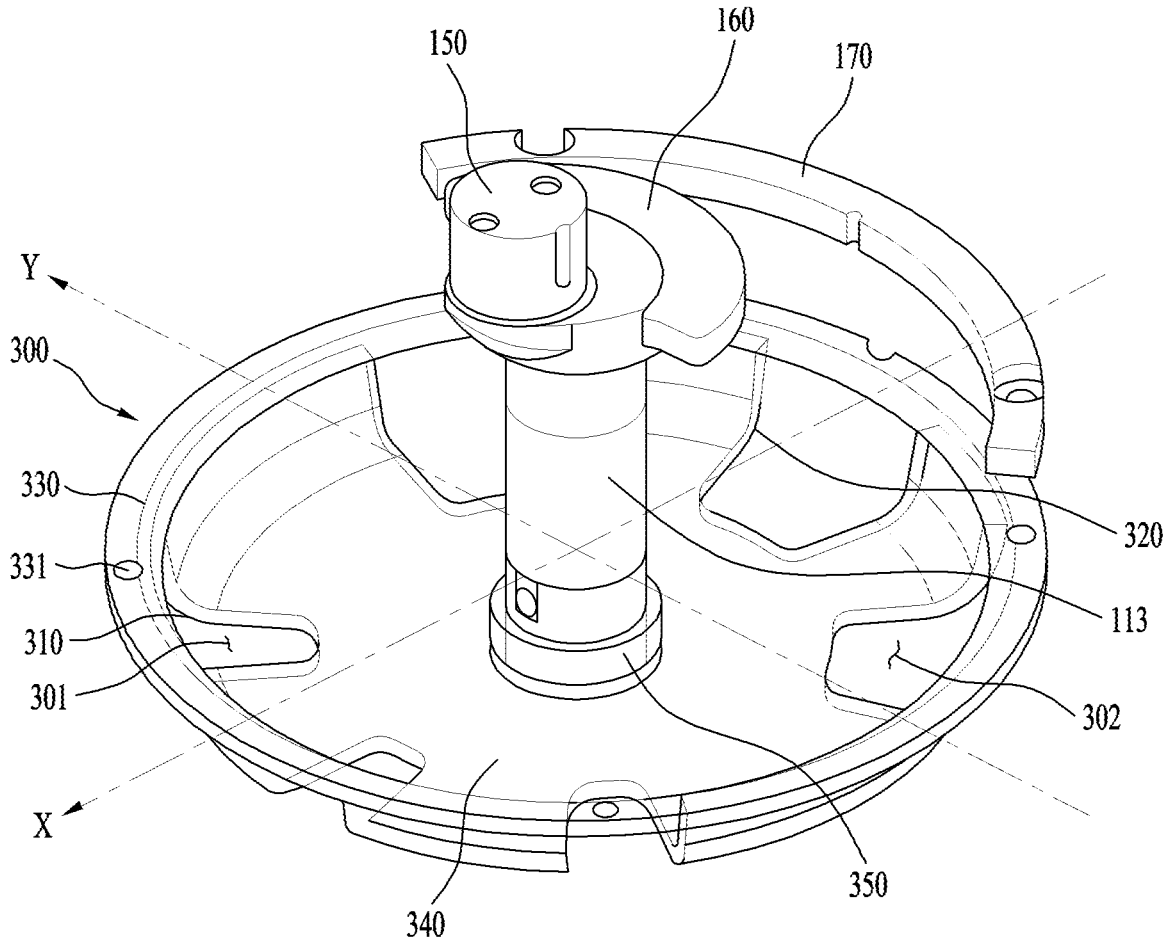
FIG. 2 is a perspective view illustrating example elements for offsetting unbalance force of a compressor.

FIG. 2 is a perspective view illustrating example elements for offsetting unbalance force of the compressor.

For examples, FIG. 2 illustrates one or more elements capable of offsetting unbalance force (or unbalance moments) generated by movement of at least one of the piston 116 and the eccentric part 150. The one or more elements may compensate or counterbalance the unbalance force or unbalance moments.

In some implementations, the elements for offsetting such unbalance force may include a counter weight 160 that is located at the end of the rotary shaft 113 and that is located at an opposite side of the eccentric part 150.

For convenience of description and better understanding of the present disclosure, one direction in which the piston 116 causing unbalance force and a center of gravity (C.G.) caused by the eccentric part 150 are placed will hereinafter be defined as an X-axis direction. In addition, another direction orthogonal to the X-axis direction in a virtual plane in which the piston 116 can reciprocate will hereinafter be defined as a Y-axis direction. For example, the piston 116 may be configured to reciprocate along or in a movement plane defined by the X-Y axes.

According to the above-mentioned definition, the direction in which the eccentric part 150 is placed will hereinafter be referred to as a positive (+) X-axis direction, and the other direction in which the counter weight 160 is placed will hereinafter be referred to as a negative (−) X-axis direction.

In some cases, it may be difficult to increase the size of the counter weight by a predetermined size or greater due to reasons such as position interference, such that additional offset elements may be needed.

Further, as an additional element for offsetting such unbalance force, the compressor 100 may include a balance weight 170 installed in the same direction (i.e., (−) X-axis direction) as in the counter weight 160. That is, the balance weight 170 may be installed at the opposite side of the eccentric part 150 in the same manner as in the counter weight 160.

In addition, the elements to offset unbalance force may include the rotor frame 300 having mass (weight) distribution capable of offsetting such unbalance force.

As described above, when using the motor 120 having the outer rotor structure, the rotor frame 300 may be needed to transmit rotational force of the motor 120 to the rotary shaft 113.

In the center part of the rotor frame 300, the coupling hole 350 fixed and coupled to the rotary shaft 113 may be formed. The edge part 330 coupled to the rotor 122 (see FIG. 1) of the motor 120 may be located outside the center part of the rotor frame 300. The coupling hole 350 and the edge part 330 may be interconnected by the panel-shaped plate part 340 having substantially uniform thickness.

The rotor frame 300 may have heavier mass (heavier weight) distribution in the opposite direction (i.e., the X-axis direction) of the balance weight 170 with respect to the rotation direction of the rotary shaft 113.

In other words, the rotor frame 300 may have heavier mass (heavier weight) distribution in the same direction (i.e., the X-axis direction) as in the eccentric part 150 with respect to the rotation direction of the rotary shaft 113.

That is, as shown in the drawings, the opposite direction (i.e., the X-axis direction) of the balance weight 170 may be identical to the direction of the eccentric part 150.

In addition, the above mass distribution may be achieved by different sizes of holes 301 and 302 formed in the panel-shaped plate part 340.

That is, the hole 301 formed in the opposite direction of the balance weight 170 may be smaller in size than the hole 302 formed in the same direction as the balance weight 170. For instance, a circumferential width of the hole 301 may be less than a circumferential width of the hole 302. In another, a radial width of the hole 301 may be less than a radial width of the hole 302.

In some cases, the hole 301 formed in the opposite direction of the balance weight 170 may be formed by a first cutting part 310 formed in the opposite direction of the balance weight 170, and the hole 302 formed in the same direction as the balance weight 170 may be formed by a second cutting part 320 formed in the same direction as the balance weight 170.

The edge part 330 of the rotor frame 300 may include a coupling hole 331 to be coupled to the rotor 122.

In this case, the balance weight 170 may be formed in an annular shape. That is, the balance weight 170 may have a partial annular shape distributed in the opposite direction of the eccentric part 150.

Figure 3:
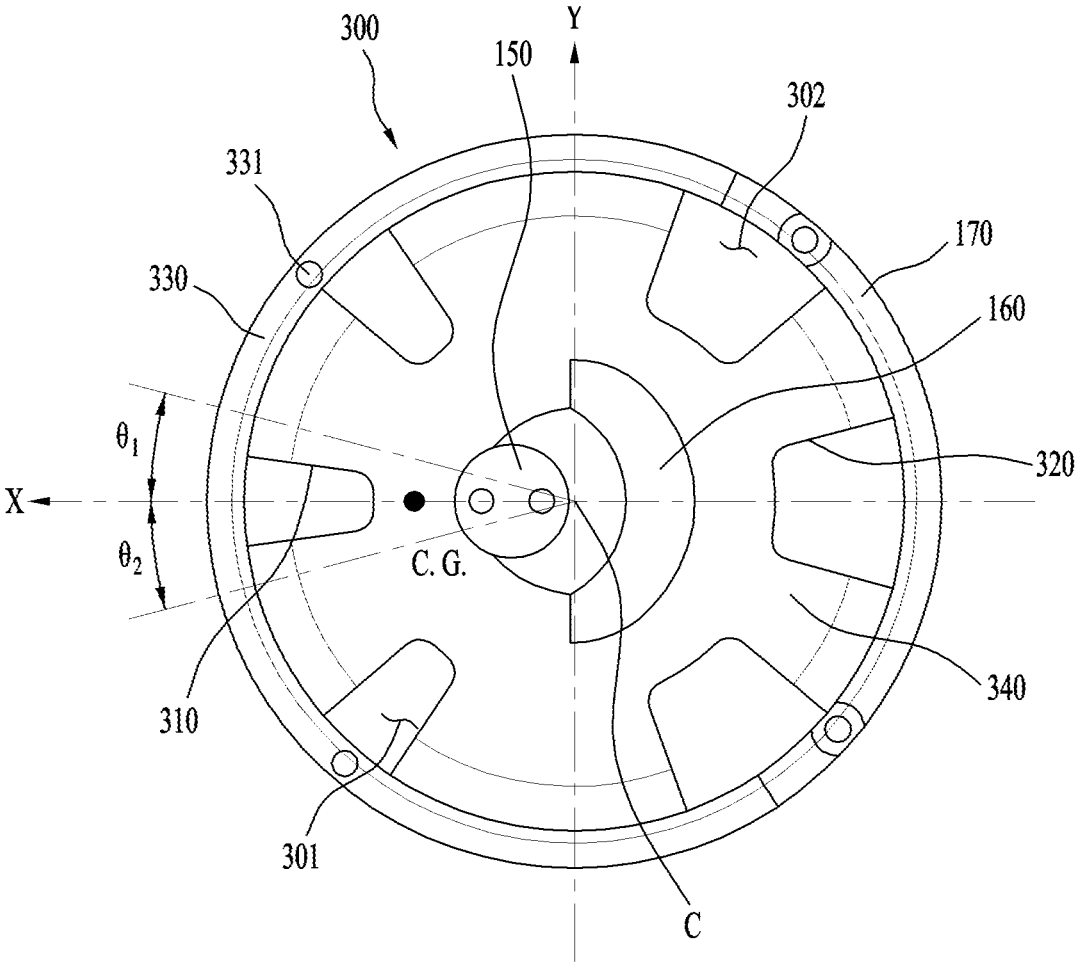
FIG. 3 is a plan view illustrating an example rotor frame.

FIG. 3 is a plan view illustrating the rotor frame 300.

The rotor frame 300 having mass (weight) distribution capable of offsetting unbalance force from among the above-mentioned elements for offsetting such unbalance force will hereinafter be described with reference to FIG. 3.

As described above, the rotor frame 300 may have heavier mass (heavier weight) distribution in the opposite direction (i.e., the X-axis direction) of the balance weight 170 with respect to the rotation direction of the rotary shaft 113.

In some implementations, the above mass distribution may be achieved by different sizes of holes 301 and 302 formed in the panel-shaped plate part 340.

For instance, the hole 301 formed in the opposite direction (i.e., X-axis direction) of the balance weight 170 with respect to the rotation direction of the rotary shaft 113 may be smaller in size than the hole 302 formed in the same direction (i.e., (−) X-axis direction) as the balance weight 170.

Therefore, assuming that the center point of the rotor frame 300 is an origin (C) where the X-axis and the Y-axis meet, the hole 301 formed in the left direction (i.e., X-axis direction) with respect to the Y-axis may be smaller in size than the hole 302 formed in the right direction (i.e., (−) X-axis direction) with respect to the Y-axis.

As a result, from among the total mass distribution of the rotor frame 300, one half mass distribution arranged in the left direction (i.e., the X-axis direction) with respect to the Y-axis may be heavier than the other half mass distribution arranged in the right direction (i.e., (−) X-axis direction) with respect to the Y-axis.

In addition, in a situation in which the above-mentioned mass distribution is represented as an angle with respect to the center (C) of rotation (hereinafter referred to as a rotation center C), if the position (i.e., the piston direction: X-axis direction) of the eccentric part 150 is set to an angle of 0°, the hole 302 formed between the angle of 90° and the angle of 270° with respect to the rotation center (C) may be larger in size than the other hole 301 formed in the remaining parts other than the range of 90° to 270°.

Therefore, in a situation in which the position (i.e., the piston direction) of the eccentric part 150 is set to an angle of 0°, mass distributed between the angle of 90° and the angle of 270° with respect to the rotation center (C) may be lighter than mass distributed in the remaining parts.

In addition, according to the above-mentioned mass distribution, the center of gravity (C.G.) of the rotor frame 300 may be positioned between the angle of 90° and the angle of 270° with respect to the rotation center (C).

More specifically, according to the above-mentioned mass distribution, the center of gravity (C.G.) of the rotor frame 300 may be positioned between the angle of 340° and the angle of 20° with respect to the rotation center (C) when viewed from the direction of the eccentric part 150.

That is, as can be seen from FIG. 3, $\theta_1$ may be set to an angle of +20° with respect to the angle of 0°, and $\theta_2$ may be set to an angle of −20° with respect to the angle of 0°.

The above-mentioned mass distribution of the rotor frame 300 may be used to offset unbalance force generated in the direction perpendicular to a plane (i.e., X-Y plane) in which movement of the piston 116 is achieved.

That is, assuming that the direction perpendicular to the X-Y plane is defined as the Z-axis direction, mass distribution of the rotor frame 300 may offset Z-directional unbalance force (or Z-directional unbalance moments) generated by movement of at least one of the piston 116 and the eccentric part 150.

Figure 4:
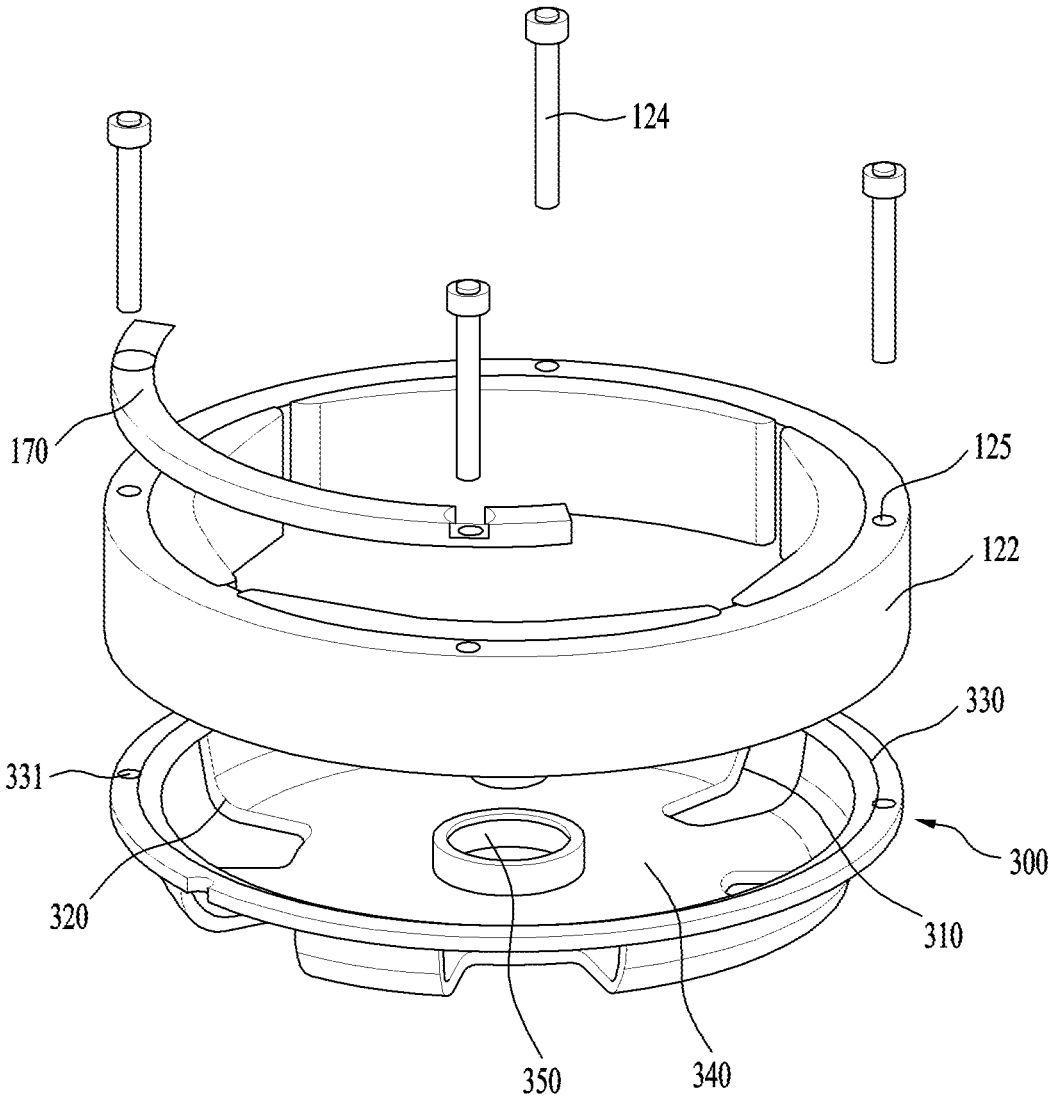
FIG. 4 is an exploded perspective view illustrating an example of coupling parts of a rotor frame.

FIG. 4 is an exploded perspective view illustrating an example of a coupling state or coupling components of the rotor frame.

Referring to FIG. 4, the rotor frame 300 may be coupled to the rotor 122 of the motor.

In more detail, the edge part 330 of the rotor frame 300 may be coupled in contact with the rotor 122 of the motor.

As described above, the coupling hole 331 may be formed in the edge part 330 of the rotor frame 300. In addition, a through-hole 125 may be formed at a position corresponding to the coupling hole 331. Therefore, a coupling bolt 124 may pass through the through-hole 125, such that the coupling bolt 124 may be installed in the coupling hole 31 formed in the edge part 330 of the rotor frame 300.

In this case, when the rotor frame 300 is coupled to the rotor 122 through the coupling bolt 124, the balance weight 170 may also be coupled to the rotor 122.

As described above, in the compressor structure, the balance weight 170 may be coupled to the upper part of the rotor 122.

In some cases, the compressor including the motor having the outer rotor structure may have difficulty in stably installing an additional balance weight to the lower part of the rotor 122, and spatial restriction may also occur in such installation.

In some implementations, the rotor frame 300 having the above-mentioned mass (weight) distribution may substitute for the additional balance weight capable of being located at the lower part of the rotor 122.

The rotor frame 300 may offset Z-directional unbalance force (or Z-directional unbalance moments) generated by movement of at least one of the piston 116 and the eccentric part 150.

In the case of using the compressor including the motor provided with the outer rotor structure, the rotor frame 300 may be requisite for the compressor. As a result, the rotor frame 300 can effectively offset unbalance force (or unbalance moments) generated by movement of at least one of the piston 116 and the eccentric part 150 without using additional elements.

In addition, the holes 301 and 302 in which mass (weight) distribution capable of offsetting unbalance force (or unbalance moments) in the rotor frame 300 may also be used as oil passages.

As a result, vibration of the compressor body can be minimized, and noise caused by such vibration can be reduced, such that breakage or damage of the compressor affected by excessive vibration can be prevented.

Figure 5:
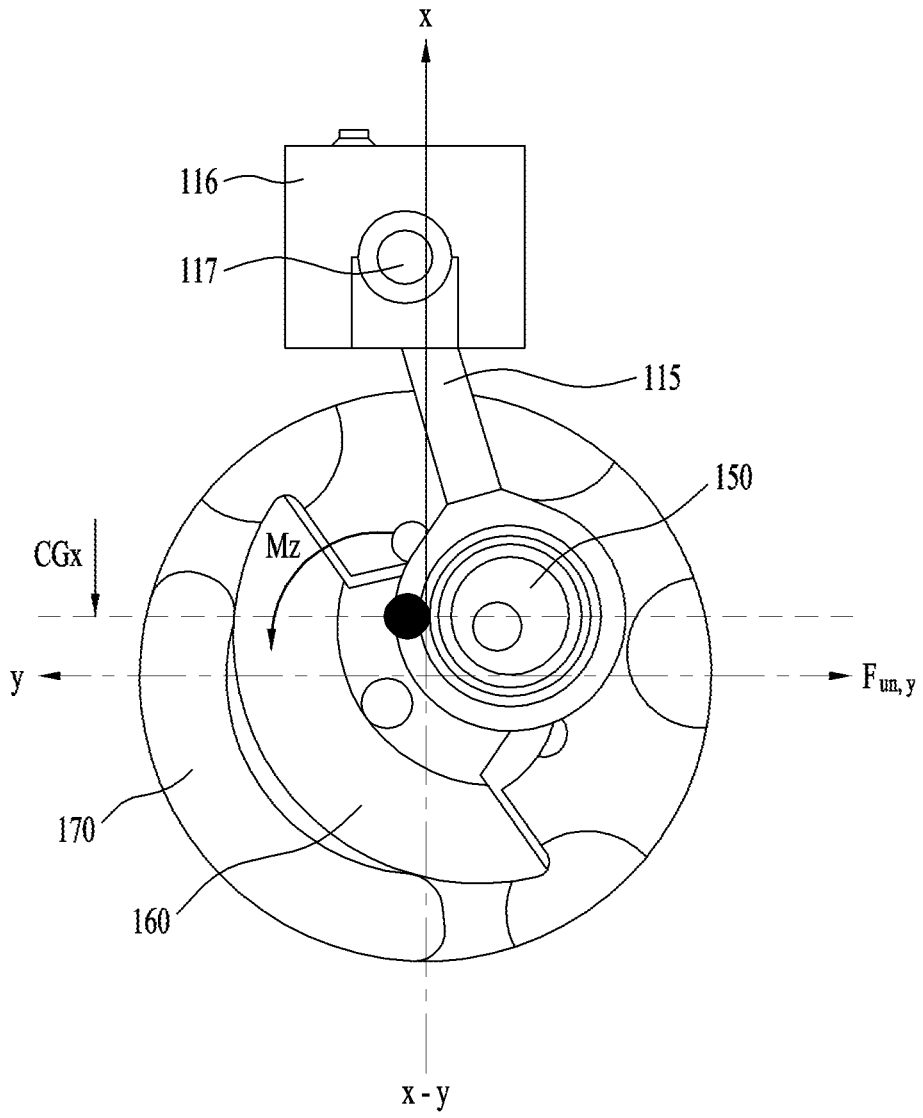
FIGS. 5 to 7 are conceptual diagrams illustrating an example balance design of the compressor.
Figure 6:
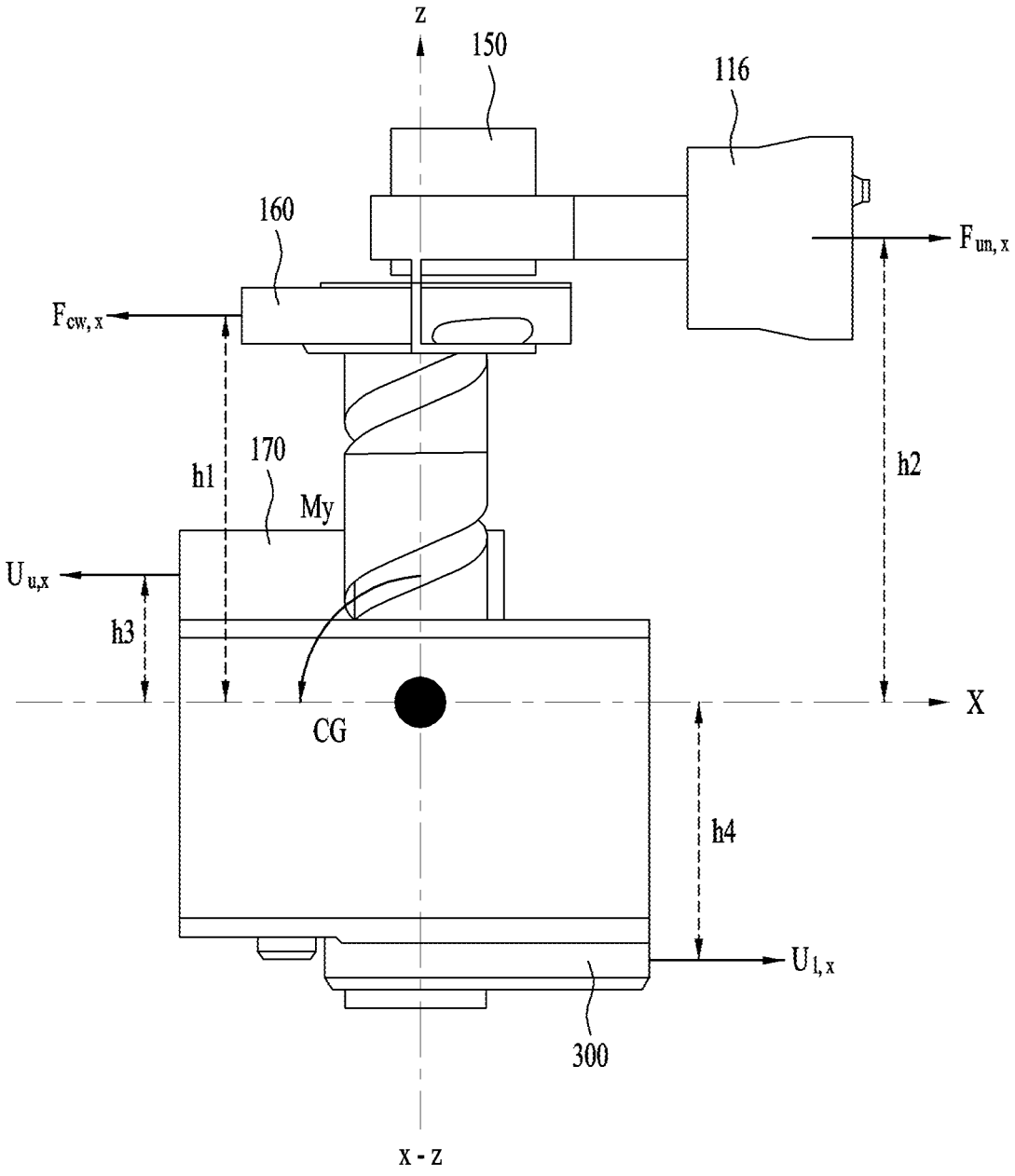
Figure 7:
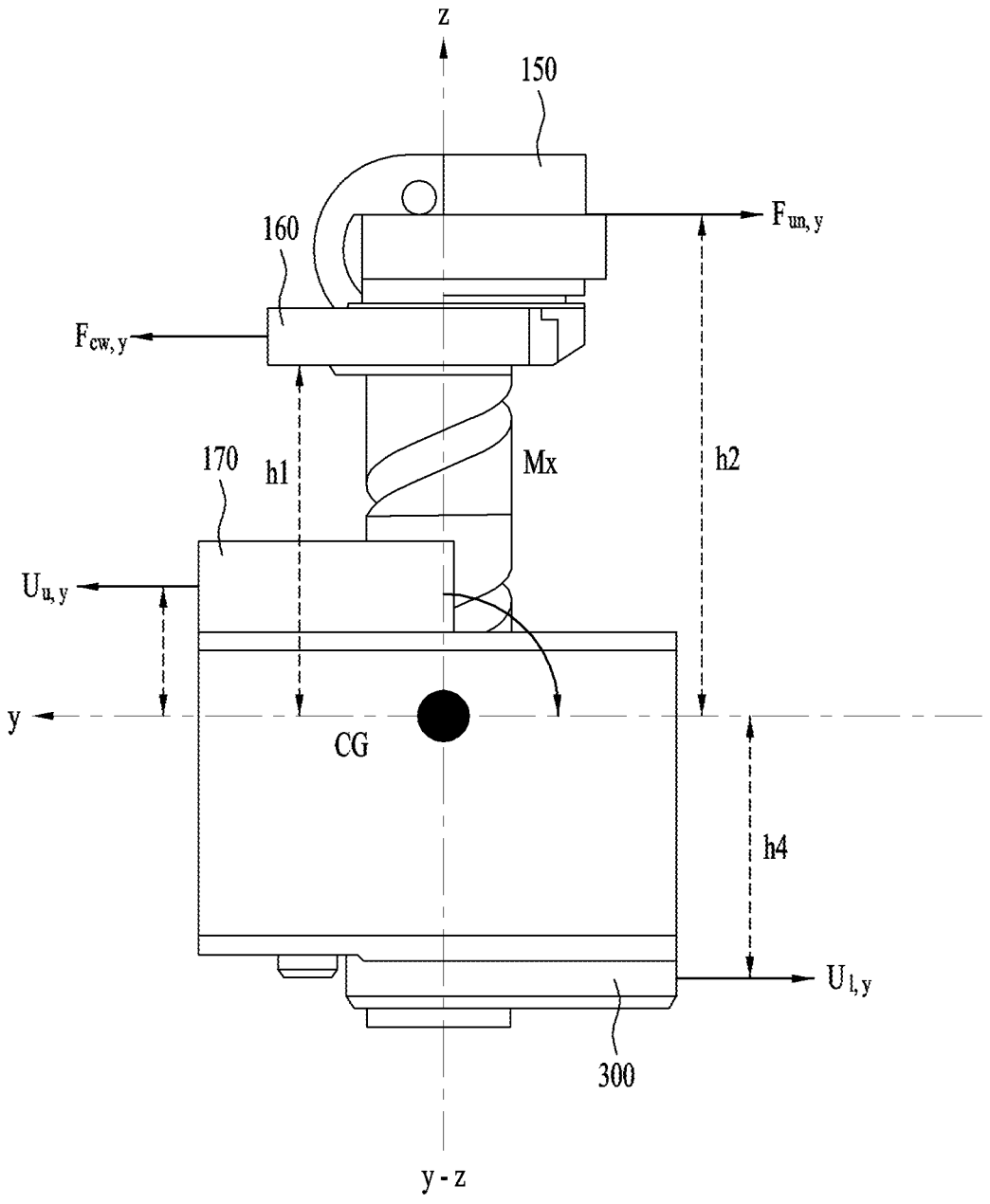

FIGS. 5 to 7 are conceptual diagrams illustrating examples of a balance design of an example compressor.

Specifically, FIG. 5 is a conceptual diagram illustrating example force generated in the X-Y direction during movement of the piston of the compressor. FIG. 6 is a conceptual diagram illustrating example force generated in the X-Z direction during movement of the piston of the compressor. FIG. 7 is a conceptual diagram illustrating example force generated in the Y-Z direction during movement of the piston of the compressor.

The balance design of the compressor will hereinafter be described with reference to FIGS. 5 to 7.

The reciprocating compressor may compress fluid (refrigerant) through reciprocation movement of the piston 1216 connected to the crank shaft (rotary shaft) 113 provided with the eccentric part 150.

In this case, not only the eccentric part (crank pin) 150, but also the connection rod 115, the piston pin 117 and the piston 116 that are connected to the eccentric part (crank pin) 150 may be considered mass causing unbalance force, and the eccentric part (crank pin) 150 and each of the connection rod 115, the piston pin 117, and the piston 116 may be considered factors causing vibration of the compressor body.

In some examples, although the counter weight 160 is formed in the rotary shaft 113 so as to offset unbalance force, position interference may unavoidably occur, so that it may be difficult for the counter weight 160 to be formed with a sufficient size due to such position interference.

For instance, the counter weight 160 may interfere with the connection rod 115 in an upward direction. Interference between the cylinder block 110 and the piston 116 may occur in the radial movement of the counter weight 160, such that an additional offsetting (cancellation) element may be needed.

The additional offsetting element may include the balance weight 170, and the balance weight 170 may be mounted and installed to the upper side of the rotor 122.

In this case, unbalance force caused by movement of the piston 116 and/or by rotation of the eccentric part 150 may be offset against each other using the counter weight 160 and the balance weight 170. In some cases, the counter weight 160 and the balance weight 170 may have difficulty in sufficiently offsetting moment force generated in the direction perpendicular to a virtual plane in which the piston 116 can reciprocate. As a result, the compressor body may vibrate in a vertical direction.

In order to offset vibration caused by such vertical moment, an additional mass element (lower balance weight) may be attached to the lower side of the rotor 122. In this case, the additional mass element may be installed in the same direction as the eccentric part 150.

In this case, as described above, it may be difficult for the additional mass element (lower balance weight) to be stably installed at the lower side of the rotor 122, and spatial restriction may also occur in such installation.

The rotor frame 300 having the above-mentioned mass (weight) distribution may substitute for the additional balance weight capable of being installed at the lower side of the rotor 122.

In the drawings, '$F_{un}$' may denote unbalance force generated by the eccentric part 150, the connection rod 115, the piston pin 117, and the piston 116. That is, as can be seen from FIG. 5, '$F_{un,y}$' may denote unbalance force generated in the Y-axis direction.

In addition, may denote centrifugal force generated by the counter weight 160, '$U_n$' may denote centrifugal force generated by the upper balance weight 170, and '$U_l$' may denote centrifugal force generated by the lower balance weight (e.g., the rotor frame 300 may serve as the lower balance weight).

In FIG. 5, 'CGx' may denote how much the center of gravity (C.G.) is tilted in the X-axis direction. In addition, 'Mx' may denote unbalance moments in the X-axis direction, 'My' may denote unbalance movements in the Y-axis direction, and 'Mz' may denote unbalance movements in the Z-axis direction.

Consequently, in the above-mentioned compressor balance design, the rotor frame 300 may be designed to have the $U_l$ value indicating centrifugal force generated by the lower balance weight.

That is, due to mass distribution of the rotor frame 300, the centrifugal force corresponding to the $U_l$ value may act in the direction of the rotor frame 300 rotating by the motor 120.

Figure 8:
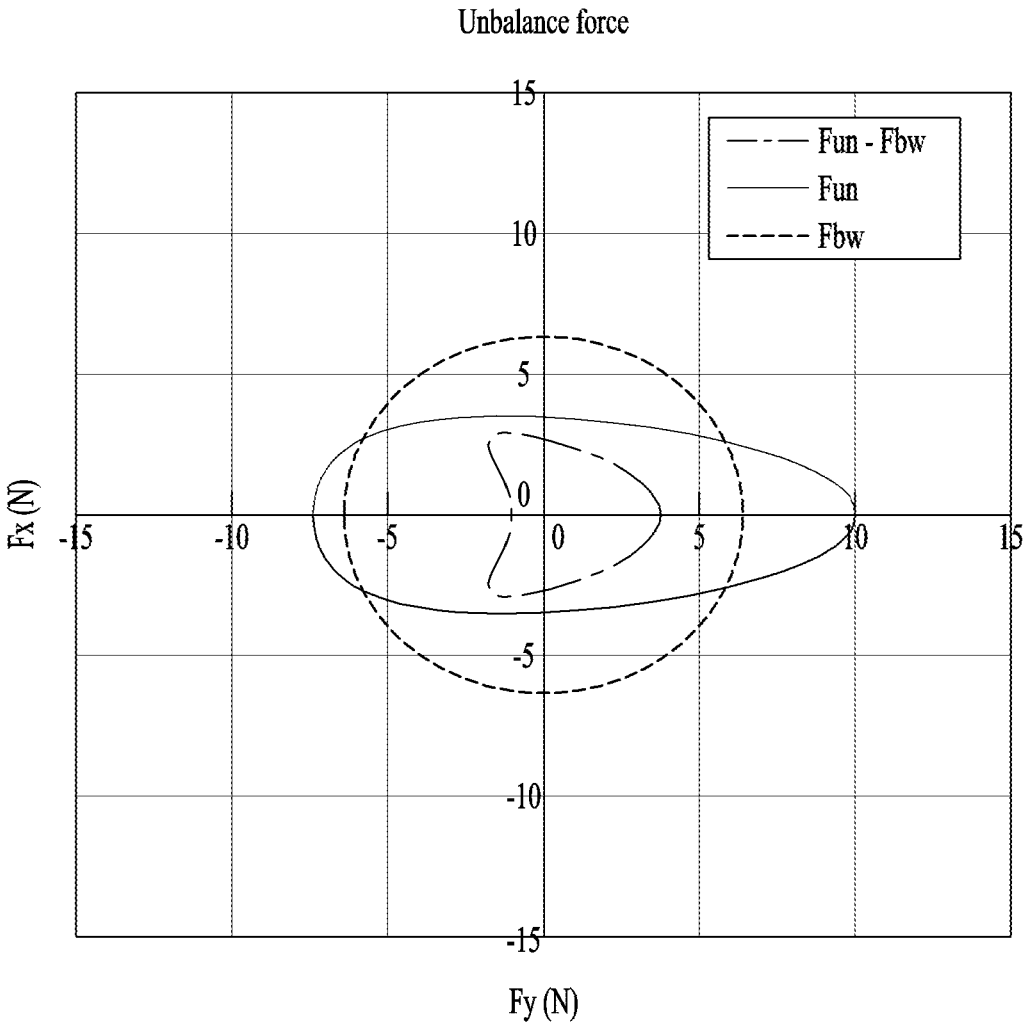
FIG. 8 is a graph illustrating an example of resultant force produced by unbalance force and offset elements in the balance design of the compressor.

FIG. 8 is a graph illustrating resultant force produced not only by unbalance force in the balance design of the compressor, but also by offset elements in the balance design of the compressor.

Unbalance force generated by the eccentric part 150, the connection rod 115, the piston pin 117, and the piston 116 may be denoted by '$F_{un}$'. In FIG. 8, force generated in the X-Y plane is illustrated, '$F_x$' may denote force generated in the X-axis direction, and '$F_y$' may denote force generated in the Y-axis direction.

In addition, offset force caused by the balance weight 170 and the rotor frame 300 may be denoted by '$F_{bw}$'.

Resultant force caused by the unbalance force '$F_{un}$' and the offset force '$F_{bw}$' may be denoted by '$F_{un}$-$F_{bw}$'. The resultant force may not be completely zero, and may be designed to be minimized.

Figure 9:
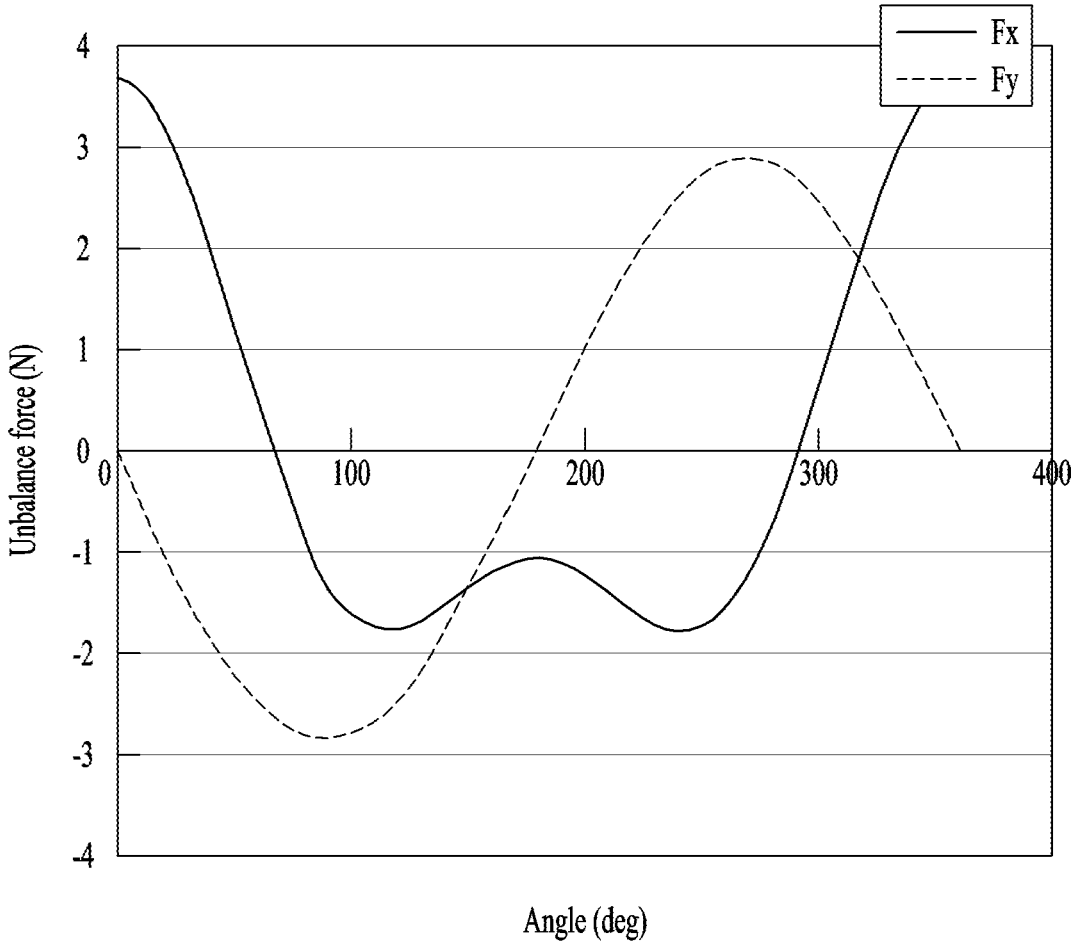
FIG. 9 is a graph illustrating an example in which unbalance force caused by the balance design of the compressor is represented according to rotation angles in each of an X-axis direction and a Y-axis direction according to the present disclosure.
Figure 10:
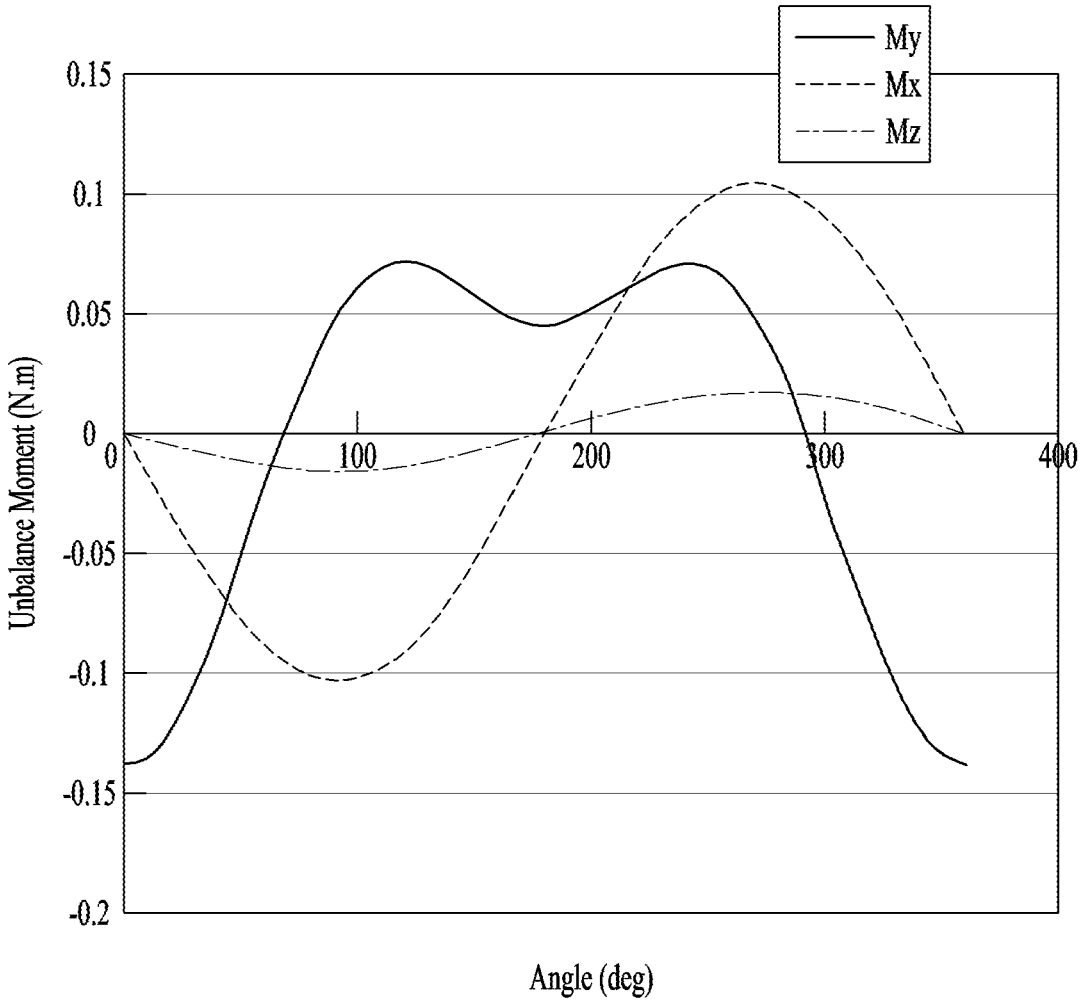
FIG. 10 is a graph illustrating unbalance moments generated in each of X-axis, Y-axis, and Z-axis directions in the balance design of the compressor according to the present disclosure.

FIG. 9 is a graph illustrating an example situation in which unbalance force caused by the balance design of the compressor is represented in different ways according to rotation angles in each of the X-axis direction and the Y-axis direction according to the present disclosure. FIG. 10 is a graph illustrating examples of an unbalance force, a balance weight, and a compensated force in each of X-axis and Y-axis directions in the balance design of the compressor.

The shape and mass of each of the balance weight 170 and the rotor frame 300 which are designed to minimize the resultant force calculated by unbalance force '$F_{un}$' and offset force '$F_{bw}$' can be designed as described above.

In some implementations, the rotor frame 300 may achieve mass distribution based on the above-mentioned configuration.

FIGS. 11 to 16 are plan views illustrating various example rotor frames.

Figure 11:
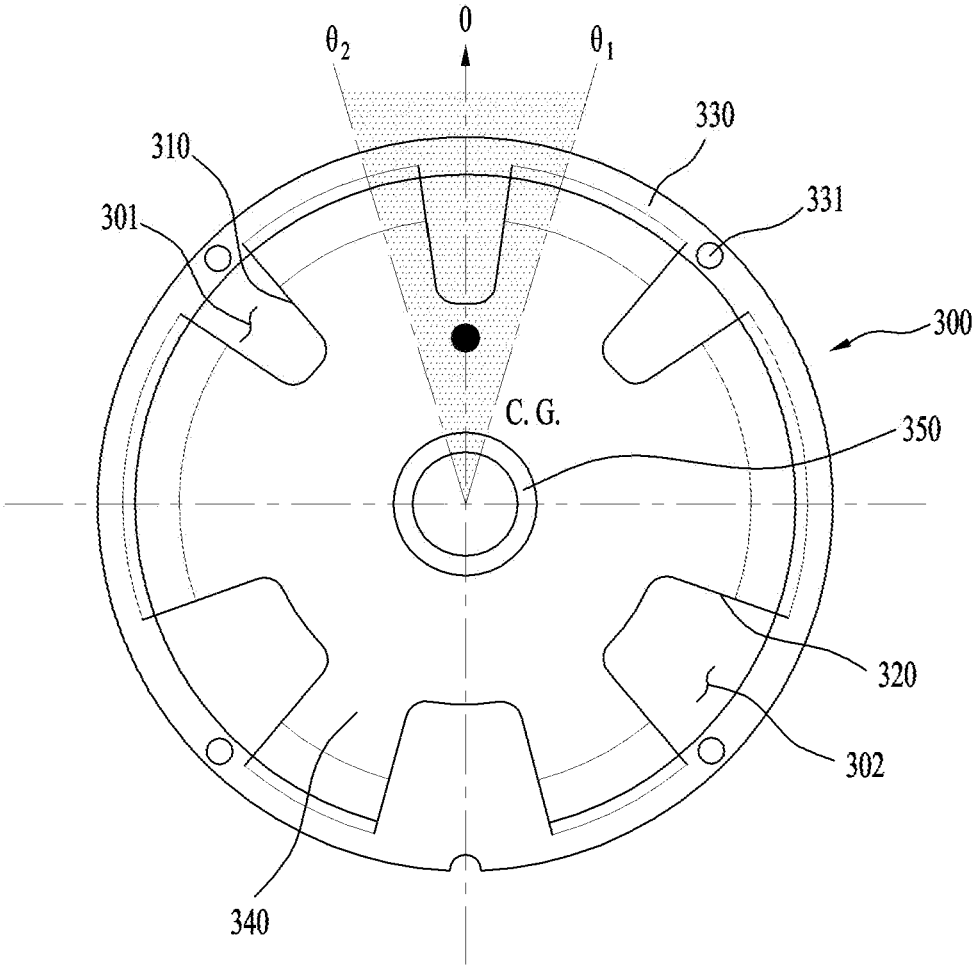
FIGS. 11-16 are plan views illustrating various examples of a rotor frame.
Figure 12:
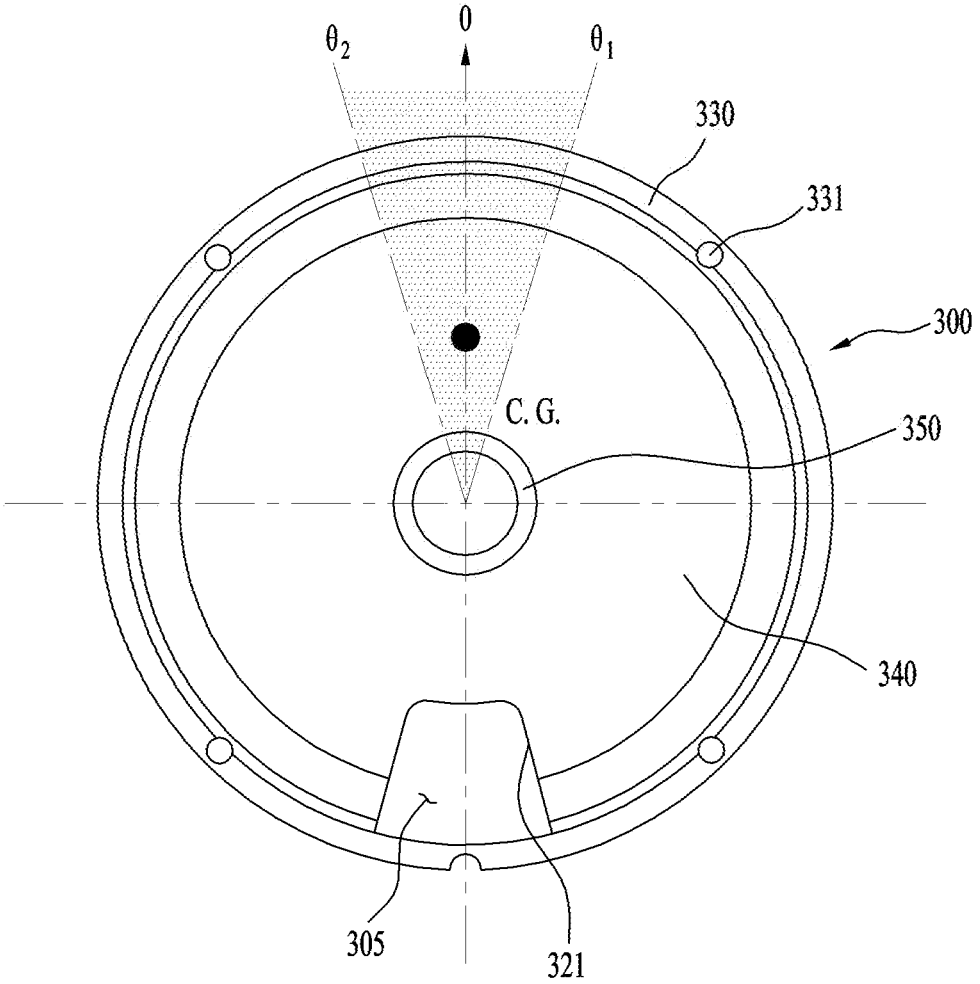
Figure 13:
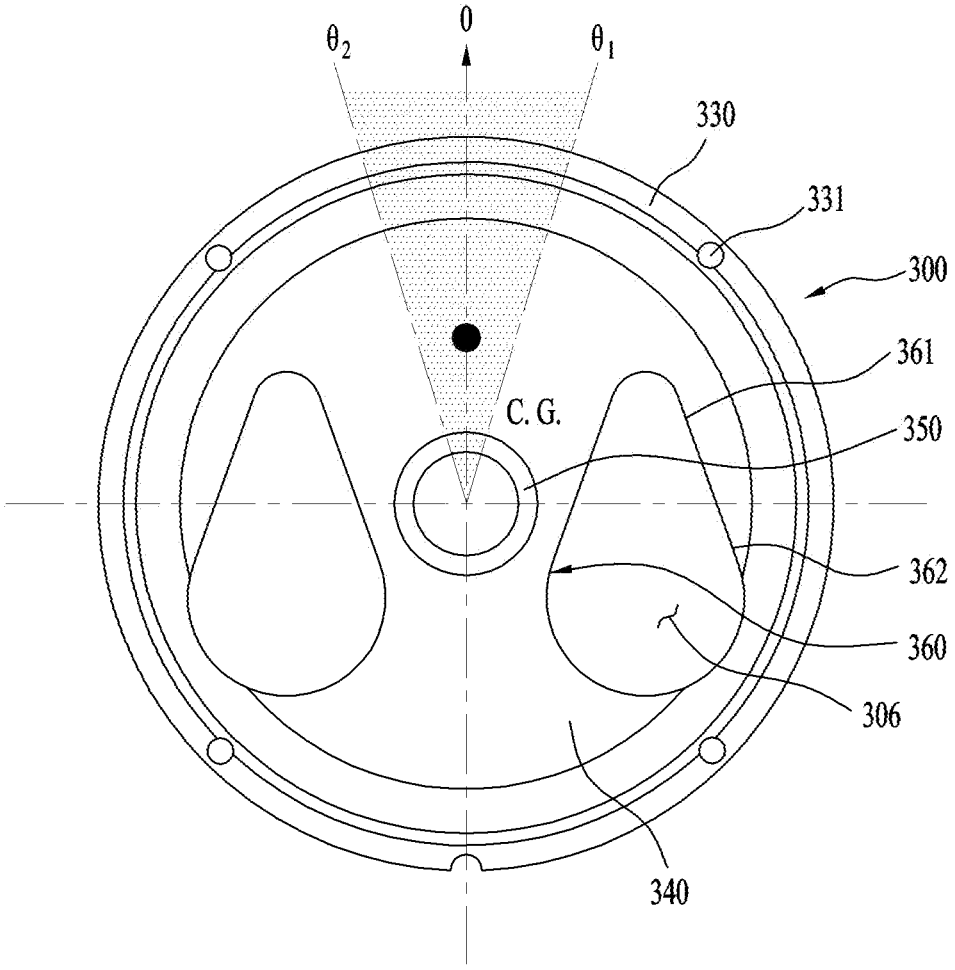
Figure 14:
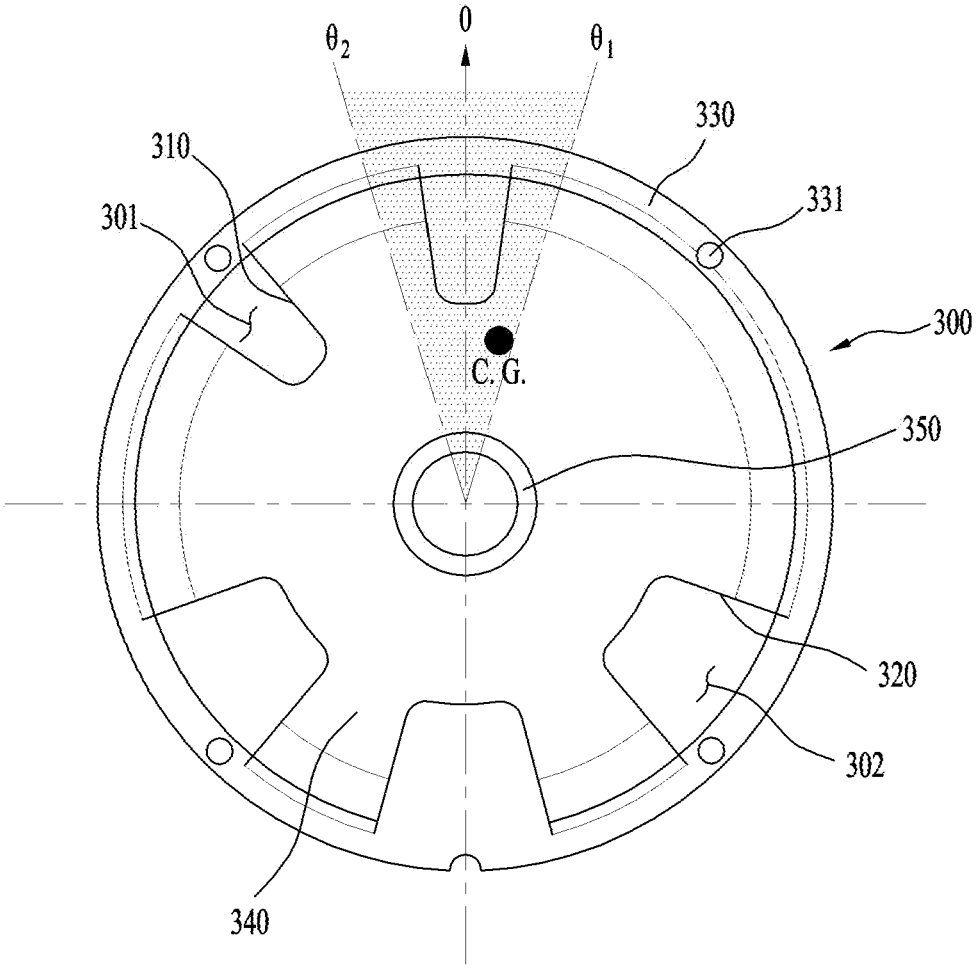
Figure 15:
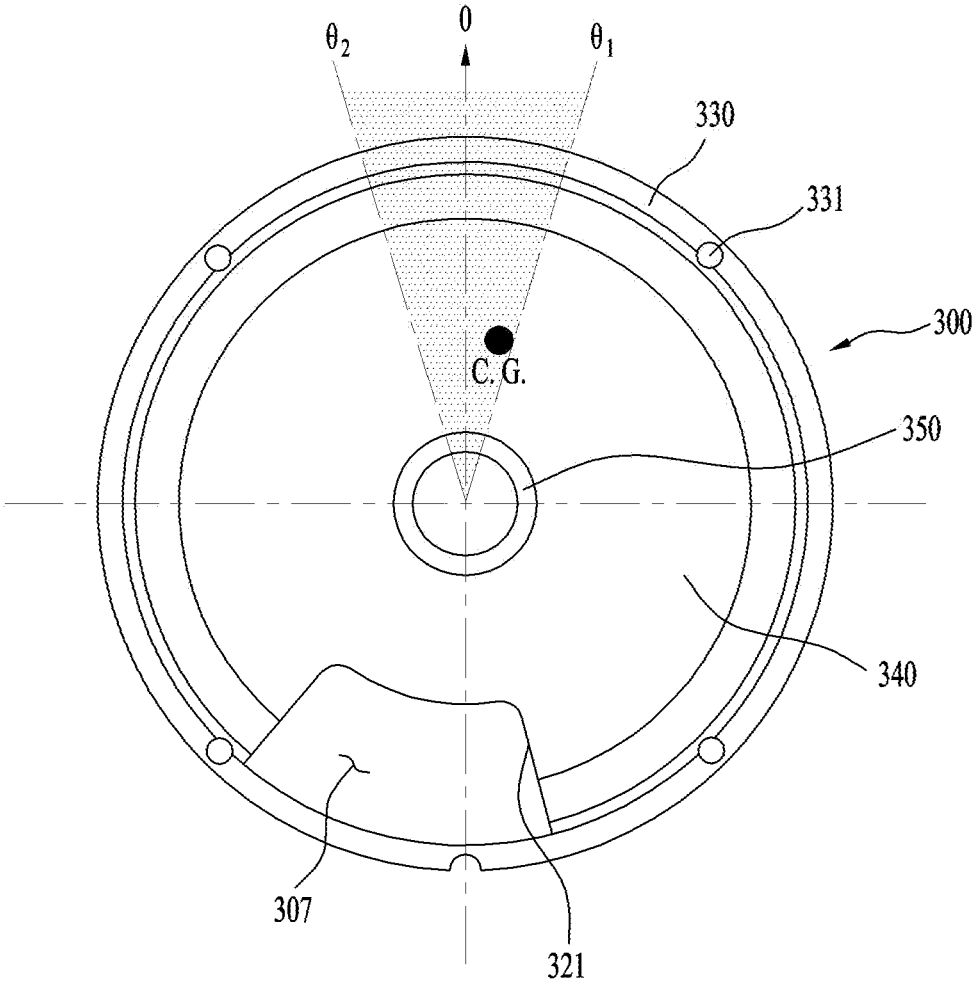
Figure 16:
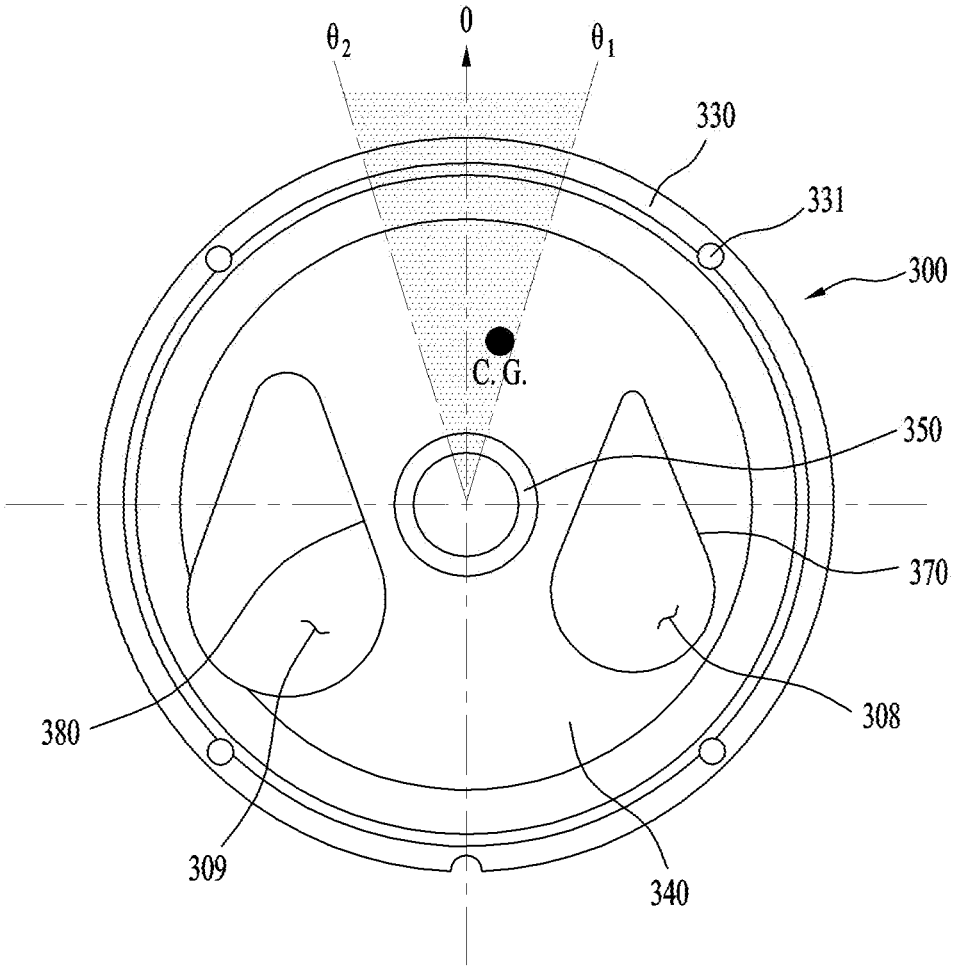

FIGS. 11 to 13 illustrate appearances of the rotor frame 300 for use in a situation in which the center of gravity (C.G.) is located at a reference position (e.g., on a line extending upward to the zero degree angle). FIGS. 14 to 16 illustrate appearance of the rotor frame 300 for use in a situation in which the center of gravity (C.G.) is offset from the reference position. FIGS. 14 to 16 illustrate appearances of the rotor frame 300 for use in a situation in which the center of gravity (C.G.) is offset from the reference position.

In some examples, as illustrated in FIGS. 11 to 16, the center of gravity (C.G.) of the rotor frame 300 may be disposed between 90° and 270° with respect to the reference position.

More specifically, according to the above-mentioned mass distribution, the center of gravity (C.G.) of the rotor frame 300 may be disposed between 340° and 20° with respect to the direction of the eccentric part 150 when viewed from the direction of the eccentric part 150. That is, as can be seen from FIGS. 11 to 16, '$\theta_1$' may be set to +20° with respect to the angle of 0°, and '$\theta_2$' may be set to −20° with respect to the angle of 0°.

In all the implementations of the present disclosure, from among the total mass distribution of the rotor frame 300, one half mass distribution arranged in one half section (i.e., an upper semicircular section of each of FIGS. 11 to 16) in which the center of gravity (C.G.) is located may be heavier than the other half mass distribution arranged in the other half section (i.e., a lower semicircular section of each of FIGS. 11 to 16).

FIG. 11 is a view illustrating the appearance of the rotor frame 300 in FIGS. 2 to 4.

Referring to FIG. 11, the mass (weight) distribution of the rotor frame 300 may be achieved by different sizes of holes 301 and 302 formed in the plate part 340 as described above.

That is, the hole 301 formed in the opposite direction of the balance weight 170 may be smaller in size than the hole 302 formed in the direction of the balance weight 170.

As can be seen from FIG. 11, three holes 301 (hereinafter referred to as first holes 301) may be formed in the opposite direction of the balance weight 170 while simultaneously being spaced apart from one another at intervals of a predetermined distance, and three holes 302 (hereinafter referred to as second holes 302) larger in size than the first holes 301 may be formed in the direction of the balance weight 170 while simultaneously being spaced apart from one another at intervals of a predetermined distance.

In this case, the hole 301 formed in the opposite direction of the balance weight 170 may be formed by the first cutting part 310 formed in the opposite direction (i.e., the direction of the center of gravity (C.G.)) of the balance weight 170. The hole 302 formed in the direction of the balance weight 170 may be formed by the second cutting part 320 formed in the direction (i.e., the opposite direction of the center of gravity (C.G.)) of the balance weight 170.

In addition, in a situation in which such mass distribution is represented as an angle with respect to the center of gravity (C.G.), the hole 302 formed between the angle of 90° and the angle of 270° with respect to the origin (0°) about the rotation center (C) may be larger in size than the other hole 301 formed in the remaining parts.

Therefore, in a situation in which the position (i.e., the piston direction) of the eccentric part 150 is set to an angle of 0°, mass distributed between the angle of 90° and the angle of 270° with respect to the rotation center (C) may be lighter than mass distributed in the remaining parts.

Such details are the same as described above, and repeated descriptions will herein be omitted here for conciseness and ease of description.

FIG. 12 is a view illustrating an example rotor frame.

Referring to FIG. 12, the rotor frame 300 has a hole 305, and it can be recognized that the same mass distribution may be achieved by only one hole 305 (i.e., a third hole 305).

In this case, the third hole 305 may be formed by a third cutting part 321 formed in the opposite direction (i.e., the direction of the center of gravity (C.G.)) of the balance weight 170.

In some implementations, the mass distribution of the rotor frame 300 may be formed by a single third hole 305 formed in the opposite direction (i.e., the direction of the center of gravity (C.G.)) of the balance weight 170, and no hole is present in the other direction opposite to the above-mentioned center-of-gravity (C.G.) direction.

In addition, in a situation in which such mass distribution is represented as an angle with respect to the rotation center (C), the third hole 305 may be present between the angle of 90° and the angle of 270° with respect to the origin (0°) about the rotation center (C), and no hole is present in the remaining parts.

Thus, in a situation in which the position (i.e., the piston direction) of the eccentric part 150 is set to an angle of 0°, mass distributed between the angle of 90° and the angle of 270° with respect to the rotation center (C) may be lighter than mass distributed in the remaining parts.

In addition, other parts not described above can be commonly applied to the above-described implementations.

FIG. 13 is a view illustrating an example rotor frame.

Referring to FIG. 13, mass distribution of the rotor frame 300 according to the third implementation may be achieved by a hole (i.e., a fourth hole) 306 through which the opposite direction (i.e., the direction of the center of gravity (C.G.)) of the balance weight 170 is connected to the direction of the balance weight 170.

In other words, the fourth hole 306 may be formed in a manner that one half side (i.e., an upper semicircular section of FIG. 13) in which the center of gravity (C.G.) is located is connected to the other half side (i.e., a lower semicircular section of FIG. 13) through the fourth hole 306. In this case, a portion 361 of the fourth hole 306 located in the half side including the center of gravity (C.G.) may be smaller in size than the remaining portion 362 of the fourth hole 306 contained in the other half side.

As depicted in FIG. 13, the fourth hole 306 may be formed at two positions located at both sides of the coupling hole 350.

Therefore, in a situation in which the position (i.e., the piston direction) of the eccentric part 150 is set to an angle of 0°, mass distributed between the angle of 90° and the angle of 270° with respect to the rotation center (C) may be lighter than mass distributed in the remaining parts.

In addition, other parts not described above can be commonly applied to the above-described implementations.

FIG. 14 is a view illustrating an example rotor frame.

Referring to FIG. 14, mass (weight) distribution of the rotor frame 300 may be achieved by different sizes of holes 301 and 302 formed in the panel-shaped plate part 340 in the same or similar manner as the example shown in FIG. 11.

In some implementations, in contrast to the example shown in FIG. 11, two holes 301 (i.e., first holes) formed in the opposite direction of the balance weight 170 may be spaced apart from each other by a predetermined distance. Three holes 302 (i.e., second holes), each of which is larger in size than the first hole 301, may be spaced apart from one another at intervals of a predetermined distance in the direction of the balance weight 170.

That is, the number of the first holes 301 contained in one half side (i.e., an upper semicircular section of FIG. 14) including the center of gravity (C.G.) may be less than the number of the second holes 302 contained in the other half side (i.e., a lower semicircular section of FIG. 14).

Therefore, in a situation in which the position (i.e., the piston direction) of the eccentric part 150 is set to an angle of 0°, mass distributed between the angle of 90° and the angle of 270° with respect to the rotation center (C) may be lighter than mass distributed in the remaining parts.

Other parts not described above may be identical or similar to those of the example shown in FIG. 11, and the above-mentioned features and details can be commonly applied to the above-mentioned implementations.

FIG. 15 is a view illustrating an example rotor frame.

Referring to FIG. 15, the rotor frame 300 defines a hole 307, and it can be recognized that the same mass distribution is achieved by only one hole 307 (i.e., a fifth hole 307).

In this case, the fifth hole 307 may be formed by the third cutting part 321 formed in the opposite direction (i.e., the direction of the center of gravity (C.G.)) of the balance weight 170.

In some implementations, the mass distribution of the rotor frame 300 may be formed by a single fifth hole 307 formed in the opposite direction (i.e., the direction of the center of gravity (C.G.)) of the balance weight 170, and no hole is present in the other direction opposite to the above-mentioned center-of-gravity (C.G.) direction.

In some implementations, in contrast to the example shown in FIG. 14, the fifth hole 307 may be tilted, in consideration of the center of gravity (C.G.), to one side of the other half side (i.e., the lower semicircular section of FIG. 15) in which the center of gravity (C.G.) is not contained.

Other parts not described above may be identical or similar to those of the example shown in FIG. 12, and the above-mentioned features and details can be commonly applied to the above-mentioned implementations.

FIG. 16 is a view illustrating an example rotor frame.

Referring to FIG. 16, mass distribution of the rotor frame 300 may be achieved by two holes 308 and 309 (i.e., a sixth hole 308 and a seventh hole 309) through which the opposite direction (i.e., the direction of the center of gravity (C.G.)) of the balance weight 170 is connected to the direction of the balance weight 170.

In other words, the sixth hole 308 and the seventh hole 309 may be formed in a manner that one half side (i.e., an upper semicircular section of FIG. 16) including the center of gravity (C.G.) is connected to the other half side (i.e., a lower semicircular section of FIG. 16) through the sixth and seventh holes 308 and 309. In this case, some parts of the sixth and seventh holes 308 and 309 located in the half side including the center of gravity (C.G.) may be smaller in size than the remaining parts contained in the other half side.

As depicted in FIG. 16, each of the sixth hole 308 and the seventh hole 309 may be formed at two positions located at both sides of the coupling hole 350. In some examples, any one of the sixth hole 308 and the seventh hole 309 may be smaller in size than the other one. For example, as shown in FIG. 16, the sixth hole 308 may be smaller in size than the seventh hole 309.

Other parts not described above may be identical or similar to those of the example shown in FIG. 13, and the above-mentioned features and details can be commonly applied to the above-mentioned implementations.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A compressor comprising:

a casing that defines a sealed inner space;

a motor located in the sealed inner space of the casing, the motor comprising:

a stator and a rotor located outside the stator, a rotary shaft coupled to the rotor, and a rotor frame that accommodates the rotor and the rotary shaft and that is configured to rotate together with the rotor and transmit rotational force of the rotor to the rotary shaft;

a cylinder block located in the sealed inner space of the casing, the cylinder block comprising a cylinder, wherein the rotary shaft comprises an eccentric part that is coupled to the cylinder block, that is configured to rotate based on the rotational force of the rotor, and that is located at a position offset from a rotational axis of the rotary shaft;

a piston coupled to the rotary shaft and configured to reciprocate in the cylinder based on rotation of the eccentric part; and a balance weight configured to offset unbalance force generated by movement of at least one of the piston or the eccentric part, wherein the rotor frame has an unbalanced mass distribution that is configured to compensate the unbalance force generated by movement of at least one of the piston or the eccentric part, wherein the rotor frame defines a plurality of holes having different sizes to thereby provide the unbalanced mass distribution of the rotor frame, the plurality of holes comprising a first hole defined at a first side facing the eccentric part and a second hole defined at a second side located opposite to the first side, and wherein the first and second holes are defined by first and second cutting parts having different widths and forming sectors arranged circumferentially at an edge of the rotor frame of the respective first and second sides.

2. The compressor according to claim 1, wherein the rotor frame comprises:

an edge part coupled to the rotor;

a center part that is coupled to the rotary shaft and that defines a coupling hole configured to receive the rotary shaft; and a plate-shaped part connects the edge part to the center part.

3. The compressor according to claim 2, wherein the rotor frame has:

a first side portion located at the first side with respect to a reference plane that is parallel to the rotational axis of the rotary shaft, wherein the eccentric part is located at a position corresponding to the first side portion of the rotor frame; and a second side portion located at the second side opposite to the first side with respect to the reference plane, and wherein a weight of the first side portion is greater than a weight of the second side portion.

4. The compressor according to claim 3, wherein the plate-shaped part defines the plurality of holes that have the different widths from each other and that provide the rotor frame with the unbalanced mass distribution.

5. The compressor according to claim 1, wherein a width of the first hole is less than a width of the second hole.

6. The compressor according to claim 1, wherein the plurality of holes further comprise:

a plurality of first holes defined at the first side of the rotor frame, the plurality of first holes including the first hole; and a plurality of second holes defined at the second side of the rotor frame, the plurality of second holes including the second hole, and wherein a number of the plurality of first holes is less than a number of the plurality of second holes.

7. The compressor according to claim 2, wherein the plate-shaped part defines the plurality of holes, wherein the plurality of holes further comprise:

a plurality of first holes defined at the first side of the rotor frame, the plurality of first holes including the first hole, and a plurality of second holes defined at the second side of the rotor frame, the plurality of second holes including the second hole, and wherein a number of the plurality of first holes is different from a number of the plurality of second holes.

8. The compressor according to claim 1, wherein the piston is configured to move along a movement plane, and wherein the unbalanced mass distribution of the rotor frame is configured to compensate a first unbalance force applied in a direction perpendicular to the movement plane of the piston.

9. The compressor according to claim 1, wherein the rotor frame has:

a first side portion located at the first side with respect to a reference plane that is parallel to the rotational axis of the rotary shaft; and a second side portion located at the second side opposite to the first side with respect to the reference plane, wherein the balance weight is located at a position corresponding to the second side portion of the rotor frame, and wherein a weight of the first side portion is greater than a weight of the second side portion.

10. A compressor comprising:

a casing that defines a sealed inner space;

a motor located in the sealed inner space of the casing, the motor comprising:

a stator and a rotor located outside the stator, a rotary shaft coupled to the rotor, and a rotor frame that accommodates the rotor and rotary shaft and that is configured to rotate together with the rotor and transmit rotational force of the rotor to the rotary shaft;

a cylinder block located in the sealed inner space of the casing, the cylinder block comprising a cylinder, wherein the rotary shaft comprises an eccentric part that is coupled to the cylinder block, that is configured to rotate based on the rotational force of the rotor, and that is located at a position offset from a rotational axis of the rotary shaft;

a piston coupled to the rotary shaft and configured to reciprocate in the cylinder based on rotation of the eccentric part; and a balance weight configured to offset unbalance force generated by movement of at least one of the piston or the eccentric part, wherein the rotor frame has an unbalanced mass distribution along a circumferential direction about the rotational axis of the rotary shaft, wherein the rotor frame defines a plurality of holes having different sizes to thereby provide the unbalanced mass distribution of the rotor frame, the plurality of holes comprising a first hole defined at a first side facing the eccentric part and a second hole defined at a second side located opposite to the first side, and wherein the first and second holes are defined by first and second cutting parts having different widths and forming sectors arranged circumferentially at an edge of the rotor frame of the respective first and second sides.

11. The compressor according to claim 10, wherein the plurality of holes are arranged along the circumferential direction, wherein the plurality of holes further comprise:

a plurality of first holes defined at a first circumferential portion of the rotor frame, the plurality of first holes including the first hole; and a plurality of second holes defined at a second circumferential portion of the rotor frame, the plurality of first holes including the first hole, and wherein a number of the plurality of first holes is different from a number of the plurality of second holes.

12. The compressor according to claim 10, wherein the rotor frame comprises:

an edge part coupled to the rotor;

a center part that is coupled to the rotary shaft and that defines a coupling hole configured to receive the rotary shaft; and a plate-shaped part that connects the edge part to the center part.

13. The compressor according to claim 12, wherein the rotor frame has:

a first side portion located at the first side with respect to a reference plane that is parallel to the rotational axis of the rotary shaft; and a second side portion located at the second side opposite to the first side with respect to the reference plane, wherein the balance weight is located at a position corresponding to the second side portion, and wherein a weight of the first side portion is greater than a weight of the second side portion.

14. The compressor according to claim 13, wherein the plate-shaped part defines the plurality of holes that have the different widths from each other and that cause the unbalanced mass distribution of the rotor frame.

15. The compressor according to claim 10, wherein a width of the first hole is less than a width of the second hole.

16. The compressor according to claim 15, wherein the first hole is connected to the second hole.

17. The compressor according to claim 14, wherein the plurality of holes further comprise:

a plurality of first holes defined at the first side of the rotor frame, the plurality of first holes including the first hole; and a plurality of second holes defined at the second side of the rotor frame, the plurality of second holes including the second hole, and wherein a number of the plurality of first holes is less from a number of the plurality of second holes.

18. The compressor according to claim 14, wherein the plurality of holes further comprise:

a plurality of first holes defined at the first side of the rotor frame, the plurality of first holes including the first hole; and a plurality of second holes defined at the second side of the rotor frame, the plurality of second holes including the second hole, and wherein each of the plurality of first holes is connected to one of the plurality of second holes.

19. The compressor according to claim 1, wherein the first and second holes are spaced apart from each another and arranged along a circumference of the rotor frame.

20. The compressor according to claim 1, wherein the rotary shaft further comprises a counter weight that is coupled to a circumference of the rotary shaft at the second side opposite to the eccentric part.

* * * * *